US007302768B2

(12) United States Patent
Gajdacs

(10) Patent No.: US 7,302,768 B2
(45) Date of Patent: Dec. 4, 2007

(54) SIGN ASSEMBLY

(76) Inventor: Gregory George Gajdacs, 272 Beech Avenue, Toronto, Ontario (CA) M4E 3J2

( * ) Notice: Subject to any disclaimer, the term of this patent is extended or adjusted under 35 U.S.C. 154(b) by 375 days.

(21) Appl. No.: 10/882,623

(22) Filed: Jul. 2, 2004

(65) Prior Publication Data

US 2006/0000130 A1 Jan. 5, 2006

(51) Int. Cl.
*G09F 21/04* (2006.01)

(52) U.S. Cl. ..... 40/591; 40/600; 40/592; 40/607.03

(58) Field of Classification Search ..... 40/600, 40/591, 592, 607.03; 404/10
See application file for complete search history.

(56) References Cited

U.S. PATENT DOCUMENTS 3,148,856 A * 9/1964 Orlando ..... 248/205.6
3,318,279 A * 5/1967 Padilla ..... 116/63 R
3,507,245 A * 4/1970 Grabow ..... 116/28 R
4,876,812 A * 10/1989 Haralson ..... 40/592
4,960,258 A * 10/1990 Stocker et al. ..... 248/473
5,388,546 A * 2/1995 Lombard ..... 116/209
6,129,035 A * 10/2000 Schweinberger ..... 116/28 R
6,892,486 B2 * 5/2005 Haggard, Jr. ..... 40/604
2005/0076552 A1 * 4/2005 Tolna et al. ..... 40/607.03
2005/0204599 A1 * 9/2005 Myles ..... 40/591

OTHER PUBLICATIONS

."Banner Supplies" single page from 2001 Grimco Product Catalog.
Springer Sidewalk Sign, Assembly Instruction, one-sided brochure, no date available.
Three pages from web page of Mr. Bill's International at www.mrbillsint.com, no date available.

* cited by examiner

*Primary Examiner*—Gary C. Hoge
(74) *Attorney, Agent, or Firm*—Merek, Blackmon & Voorhees, LLC

(57) ABSTRACT

A sign assembly for attachment to a supporting surface. The supporting surface is preferably a portion of a vehicle. The sign assembly preferably includes a display member having indicia formed thereon, a flexible member and an anchoring member operably associated with the display member for anchoring the display member to a portion of a vehicle. The flexible member allows the display member to move relative to the anchoring member to compensate for forces exerted on the display member.

23 Claims, 9 Drawing Sheets

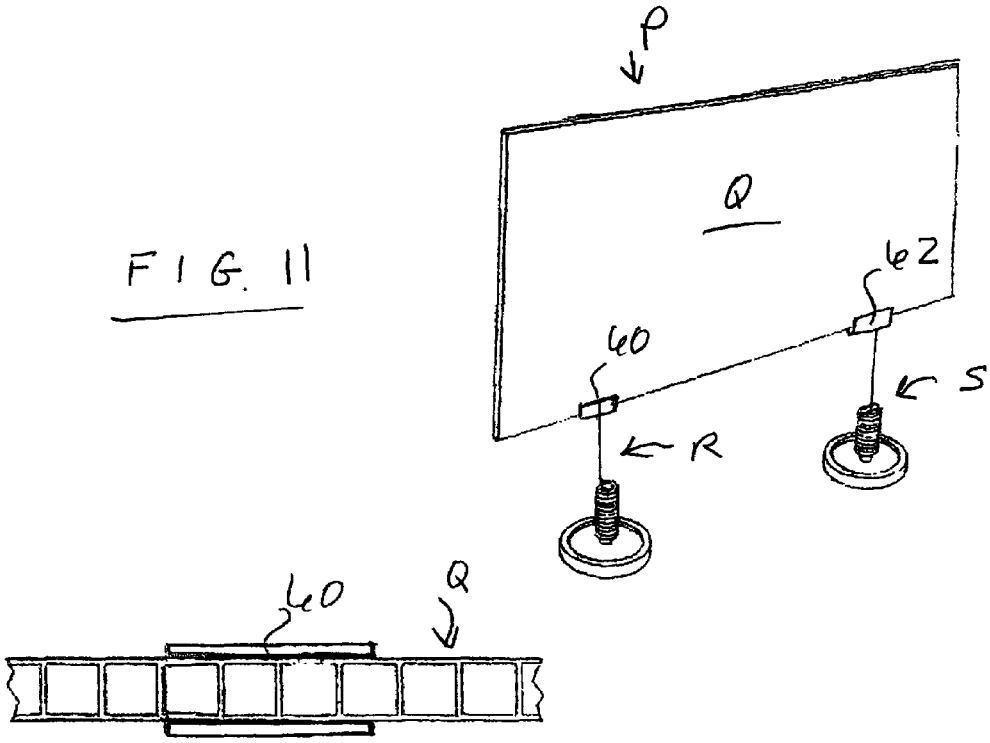
FIG. 11
FIG. 12
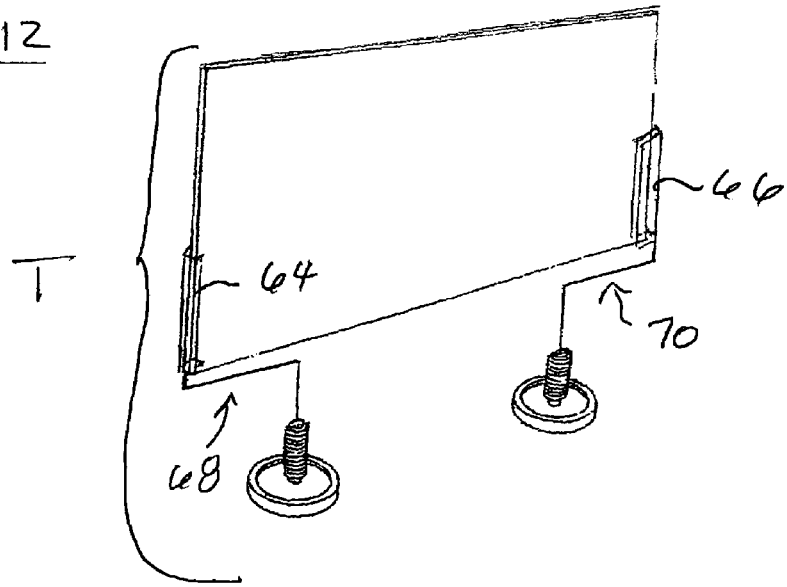
FIG. 13

SIGN ASSEMBLY

FIELD OF THE INVENTION

The present invention is directed to a sign assembly for attachment to any suitable surface. The sign assembly includes one or more display members having indicia formed thereon for communicating a message of some kind to a desired audience. In the most preferred form, the sign assembly includes an anchoring member for anchoring the display member or members to a surface of a vehicle.

BACKGROUND OF THE INVENTION

A multitude of sign assemblies have been proposed for mounting a sign to various surfaces including a vehicle. However, the prior designs have various inherent disadvantages. Such disadvantages include complex mounting arrangements that are not only expense but timing consuming to assemble. This is particularly true of sign assemblies that are designed to be mounted on both the sidewalk and on top of a stationary vehicle. One such device is the SPRINGER™ sidewalk sign manufactured by Joseph Struhl Company, Inc. located at 195 Atlantic Avenue, P.O. Box N, Garden City Park, N.Y. 11040. The Web site is www.magicmaster.com. Some of the numerous inherent disadvantages of this sign is the complex spring assembly that is used to compensate for wind striking the display sign. Another disadvantage is the large base structure that is necessary to allow the sign to be mounted on the sidewalk and on the top of a stationary vehicle.

OBJECTS AND SUMMARY OF THE INVENTION

An object of a preferred embodiment of the present invention is to provide a novel and unobvious sign assembly.

Another object of a preferred embodiment of the present invention is to provide a sign assembly that overcomes one or more disadvantages of previously known sign assemblies.

A further object of a preferred embodiment of the present invention is to provide a sign assembly that can be manufactured relatively inexpensively.

Still a further object of a preferred embodiment of the present invention is to reduce the number of components of the sign assembly so that the sign assembly can be readily and easily assembled.

Yet still another object of a preferred embodiment of the present invention is to provide a sign assembly that can readily compensate for external forces including but not limited to wind striking a sign or other display member.

Yet another object of a preferred embodiment of the present invention is to provide a sign assembly that permits a sign or other display member to be readily attached thereto.

Still another object of a preferred embodiment of the present invention is to provide a sign assembly that can be readily attached and removed from a supporting structure including but not limited to a portion of a vehicle.

It must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

In summary, one embodiment of the present invention is directed to a sign assembly for attachment to a portion of a vehicle. The sign assembly includes a display member having a top, a bottom, a front face, a rear face, a left side and a right side. The display member further includes indicia formed thereon. The sign assembly also includes at least one anchoring member operably associated with the display member for anchoring the display member to a portion of a vehicle. At least a portion of the anchoring member is magnetic and extends along only a minor portion of the bottom of the display member. The sign assembly further includes a flexible member having a longitudinal axis and first and second ends. The flexible member is disposed relative to the anchoring member such that the longitudinal axis passes through the anchoring member. The first end of the flexible member is operably associated with the anchoring member. The second end of the flexible member is operably associated with the display member such that the second end of the flexible member moves with the display member. The flexible member permits the display member to move relative to the anchoring member.

Another embodiment of the present invention is directed to a sign assembly for attachment to a surface. The sign assembly comprises a display member having a top, a bottom, a front face, a rear face, a left side and a right side. The display member has indicia formed thereon. The sign assembly also has at least one anchoring member operably associated with the display member for removably anchoring the display member to a surface. The anchoring member is disposed relative to the display member such that the anchoring member is positioned between the left side and right side of the display member. The anchoring member extends along only a minor segment of the bottom of the display member. The sign assembly further includes a flexible member having first and second ends. The first end of the flexible member is operably associated with the anchoring member while the second end of the flexible member is operably associated with the display member. The flexible member permits the display member to move relative to the anchoring member.

A further embodiment of the present invention is directed to a sign assembly for attachment to a portion of a vehicle. The sign assembly comprises a display member having a top, a bottom, a front face, a rear face, a left side and a right side. The display member has indicia formed thereon. The sign assembly also includes first and second anchoring members operably associated with the display member for anchoring the display member to a portion of a vehicle. The first anchoring member is spaced from the second anchoring member. The sign assembly further includes a first flexible member having first and second ends. The first end of the first flexible member is connected to the first anchoring member. The second end of the first flexible member is connected to the display member. The first flexible member permits the display member to move relative to the first anchoring member. The first flexible member is a single piece of flexible material.

Still a further embodiment of the present invention is directed to a sign assembly for attachment to a portion of a vehicle. The sign assembly comprises a display member having a top, a bottom, a front face, a rear face, a left side and a right side. The display member has indicia formed thereon. The sign assembly includes at least one anchoring member operably associated with the display member for anchoring the display member to a portion of a vehicle. At least a portion of the anchoring member is magnetic. The sign assembly also includes a flexible member having first and second ends. The first end of the flexible member is operably associated with the anchoring member. The second end of the flexible member is operably associated with the display member. The flexible member permits the display member to move relative to the anchoring member. The sign assembly includes a handle member for facilitating the removal of the anchoring member from a portion of the vehicle. At least a portion of the handle member is disposed between the anchoring member and the flexible member. The handle member extends along only a minor segment of the bottom of the display member.

BRIEF DESCRIPTION OF THE DRAWINGS

FIG. 11 is a perspective view of yet a further embodiment of the present invention.

FIG. 12 is a fragmentary cross-sectional view of the embodiment depicted in FIG. 11.

FIG. 13 is a perspective view of still yet a further embodiment of the present invention.

DETAILED DESCRIPTION OF THE PREFERRED EMBODIMENTS OF THE INVENTION

The most preferred forms of the invention will now be described with reference to FIGS. 1-17. The appended claims are not limited to the most preferred forms and no term used herein is to be given a meaning other than its ordinary meaning unless accompanied by a statement that the term "as used herein is defined as follows".

FIGS. 1, 2, 5 and 6

Figure 1:
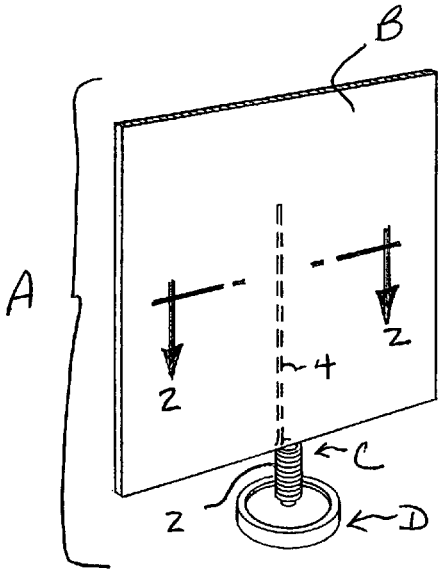
FIG. 1 is a perspective view of a sign assembly formed in accordance with the most preferred embodiment of the present invention.

Referring to FIGS. 1, 2, 5 and 6, a sign assembly A is illustrated in one of many possible configurations. The sign assembly A includes a display member B, a flexible member C and an anchoring member D. While only one display member B is shown in FIG. 1, it will be readily appreciated that more than one sign may be used in connection with one or more anchoring members D.

Figure 2:
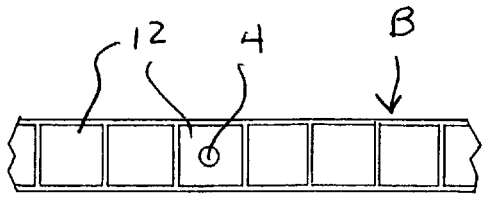
FIG. 2 is a fragmentary cross-sectional view taken along lines 2-2 in FIG. 1.

The display member B is most preferably a thin sheet of corrugated plastic material similar to that distributed by Coroplast, USA located in Dallas, Tex. As seen in FIG. 2, the corrugated plastic material has numerous openings extending therethrough. These openings allow the display member B to receive the upper portion of the flexible member C in any one of the openings 12. While this is the most preferred form for display member B, it will be readily appreciated that the shape, size and material of display member B may be readily varied as desired. Any indicia may be printed or otherwise formed on any desired surface of the display member B to communicate the desired message to the target audience.

Figure 5:
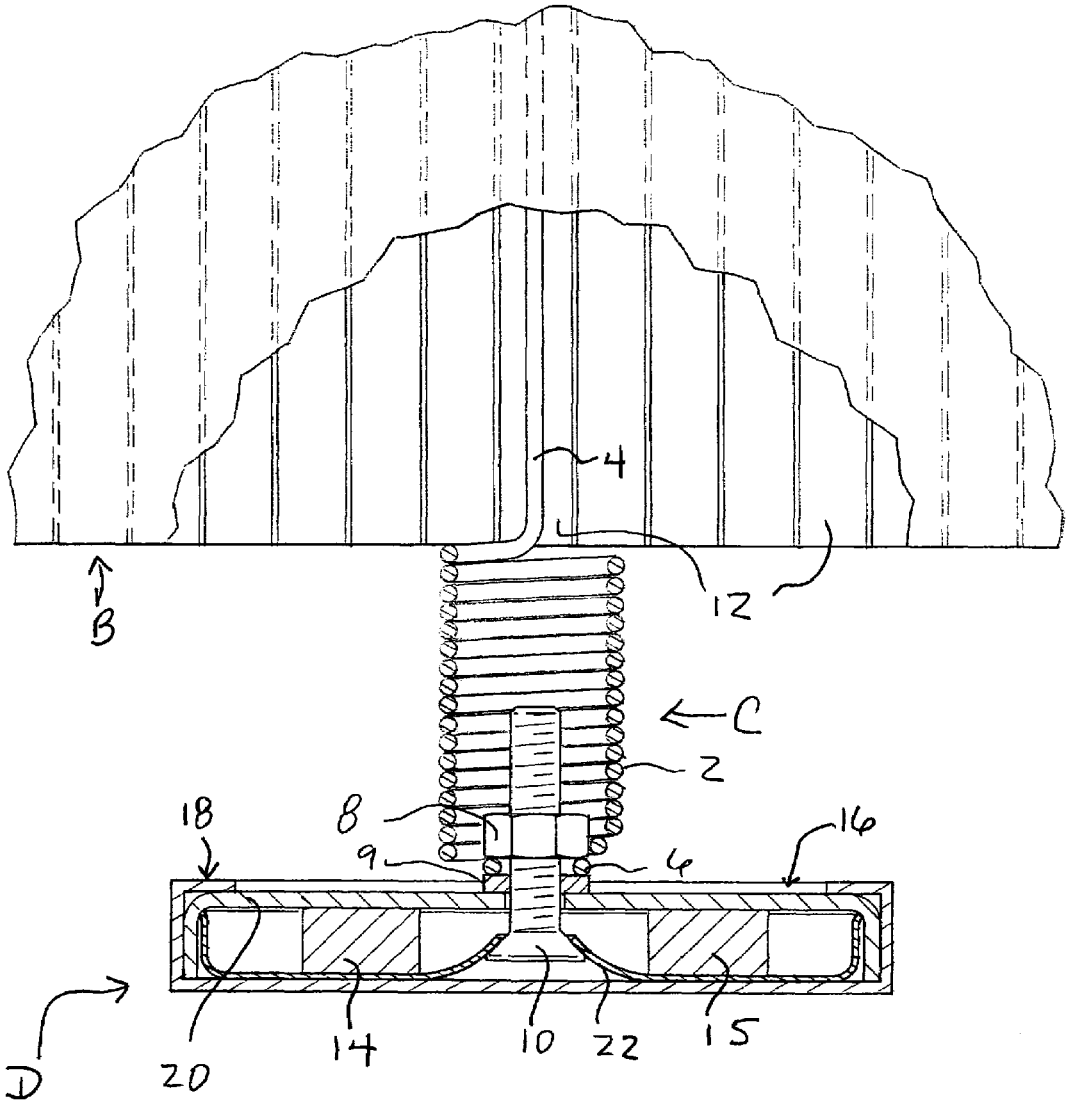
FIG. 5 is a front view, a portion of which is shown in cross-section and a portion of which is broken away, of the embodiment depicted in FIG. 1.
Figure 6:
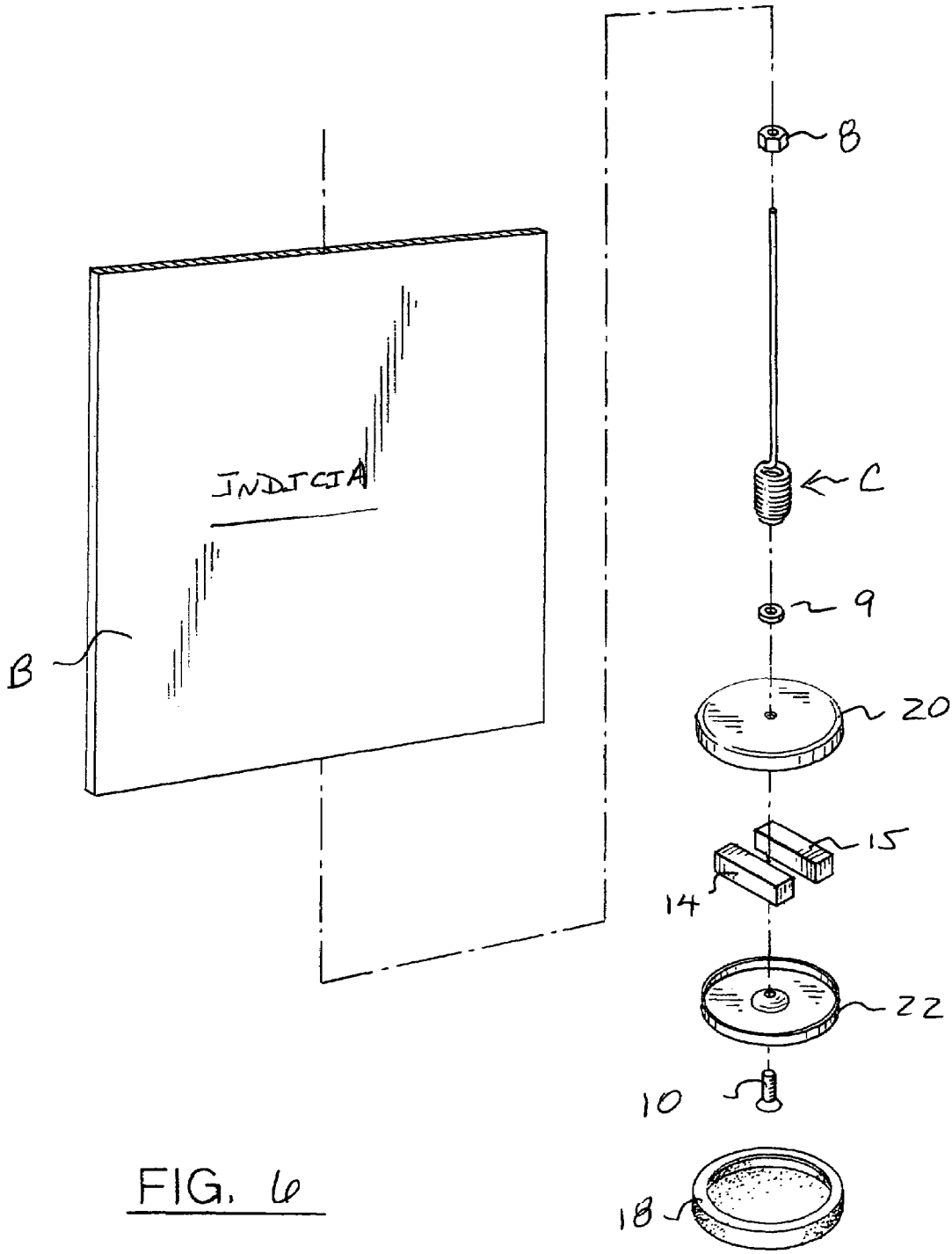
FIG. 6 is an exploded view of the embodiment depicted in FIG. 1.

Referring to FIGS. 1, 5 and 6, flexible member C is preferably a spring having a first segment 2 and a second segment 4. Preferably, the first segment 2 and the second segment 4 are formed from a single piece. First segment 2 includes a series of coils. As seen in FIG. 5, the lowermost coil 6 is preferably smaller than the other coils so that it may be held between nut 8 and washer 9. In this manner, the nut 8 and bolt 10 can readily secure the flexible member C to the anchoring member D. The washer 9 may be omitted if desired. In this instance, the lowermost coil 6 will be held securely between the nut 8 and the adjacent surface of the anchoring member D. It will be readily appreciated that numerous other fastening arrangements may be used to secure the flexible member C to the anchoring member D. The second segment 4 is preferably substantially straight so that it can be readily inserted into any desired opening 12 of the corrugated display member B. Alternatively, the second segment 4 can be formed as a plurality of coils where the coils are slightly smaller than the openings 12 in the corrugated display member B so that the display member B may be snugly secured to the flexible member C. It will be readily appreciated that other means may be used to achieve a snug fit. In addition, the second segment 4 can be forked shaped with two or more tines to prevent spinning of the display member B. Each of the tines would be received by one of the openings 12 formed in the display member B. While the preferred form the flexible member C is as described and shown herein, it will be readily appreciated that the size, shape, form and material of the flexible member C may be readily varied as desired.

Referring to FIGS. 5 and 6, the anchoring member D preferably includes a pair of magnets 14 and 15, a magnet housing 16, and an optional rubber boot 18. As is readily evident from FIG. 1, the anchoring member D extends along only a minor portion of the bottom of the display member B. The optional rubber boot 18 acts to prevent damage to the surface on which the sign assembly A is mounted. It will be readily appreciated that boot 18 can be formed from any suitable material. Preferably, the magnet housing 16 includes an upper member 20 and a lower member 22. The size, shape, strength and number of magnets may be varied as desired. The upper member 20 and the lower member 22 are preferably formed from a metal to magnify and channel the magnets strength. This is sometime referred to as closing the circuit. It will be readily appreciated that the form of the magnet housing may be varied. Further, the magnet housing may be omitted in its entirety.

Preferably, the anchoring member D is positioned relative to the flexible member C such that the longitudinal axis of the flexible member C passes through substantially the center of the anchoring member D. The flexible member C allows the display member B to move relative to the anchoring member D to compensate for forces including but not limited to wind exerted on the display member B.

Figure 3:
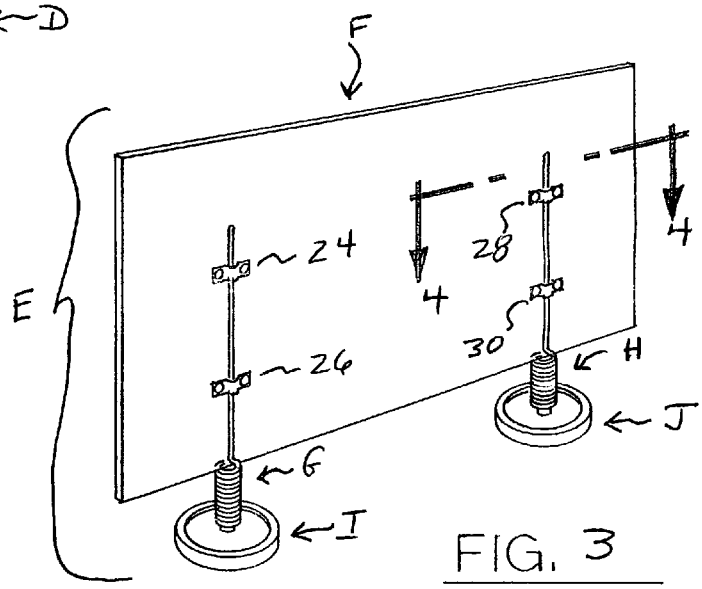
FIG. 3 is a perspective view of a sign assembly formed in accordance with another preferred form of the present invention.
Figure 4:
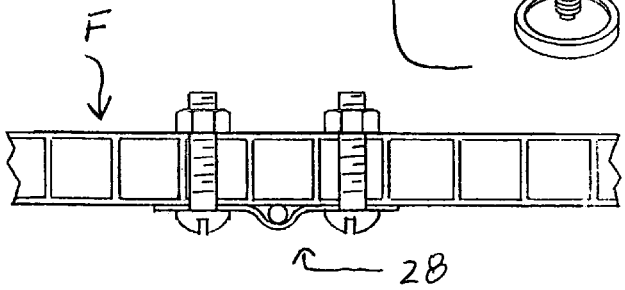
FIG. 4 is a fragmentary cross-sectional view taken along lines 4-4 in FIG. 3.
Figure 15:
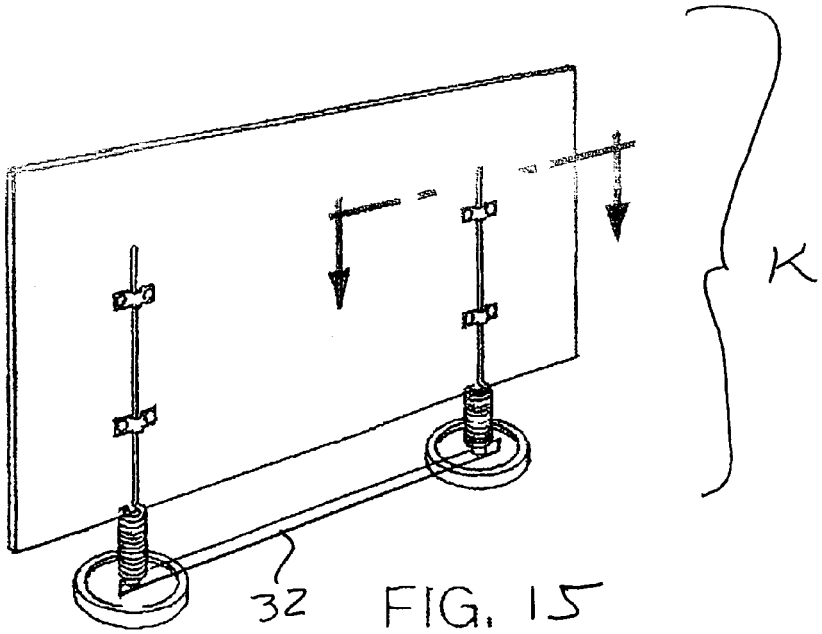
FIG. 15 is a perspective view of a further embodiment of the present invention.

FIGS. 3, 4 and 15

Referring to FIGS. 3 and 4, alternative form sign assembly E will now be described. The sign assembly E includes a display member F, flexible members G and H, and anchoring members I and J. In this alternative embodiment, the display member F is solid. It will be readily appreciated that the display member F can be formed from any suitable material. The anchoring members I and J and the flexible members G and H are similar to those depicted in FIGS. 1, 2, 5 and 6 and, therefore, will not be described in detail. Brackets 24, 26, 28 and 30 are used to attach the display member F to the flexible members G and H. It will be readily appreciated that any fastener could be used to secure the display member F to the flexible members G and H.

Referring to FIG. 15, another alternative form of sign assembly is depicted. The only difference between the sign assembly K depicted in FIG. 15 and that depicted in FIGS. 3 and 4 is the addition of a support bar 32 extending between the pair of anchoring members. The support bar 32 provides greater stability to the sign assembly K.

FIGS. 7 through 10, 16 and 17

Figure 7:
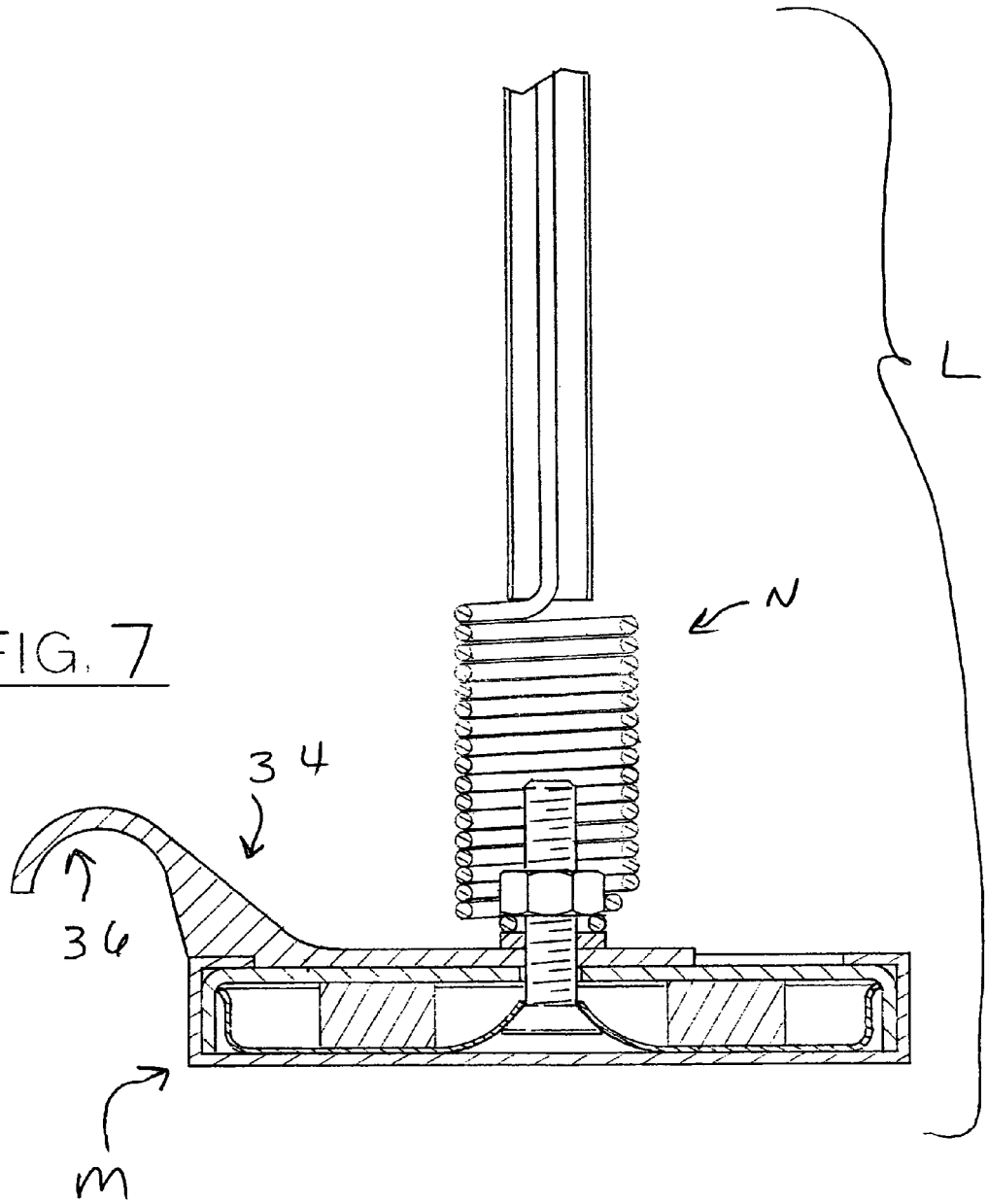
FIG. 7 is a cross-sectional view of a further embodiment of the present invention with only a portion of the sign shown.
Figure 10:
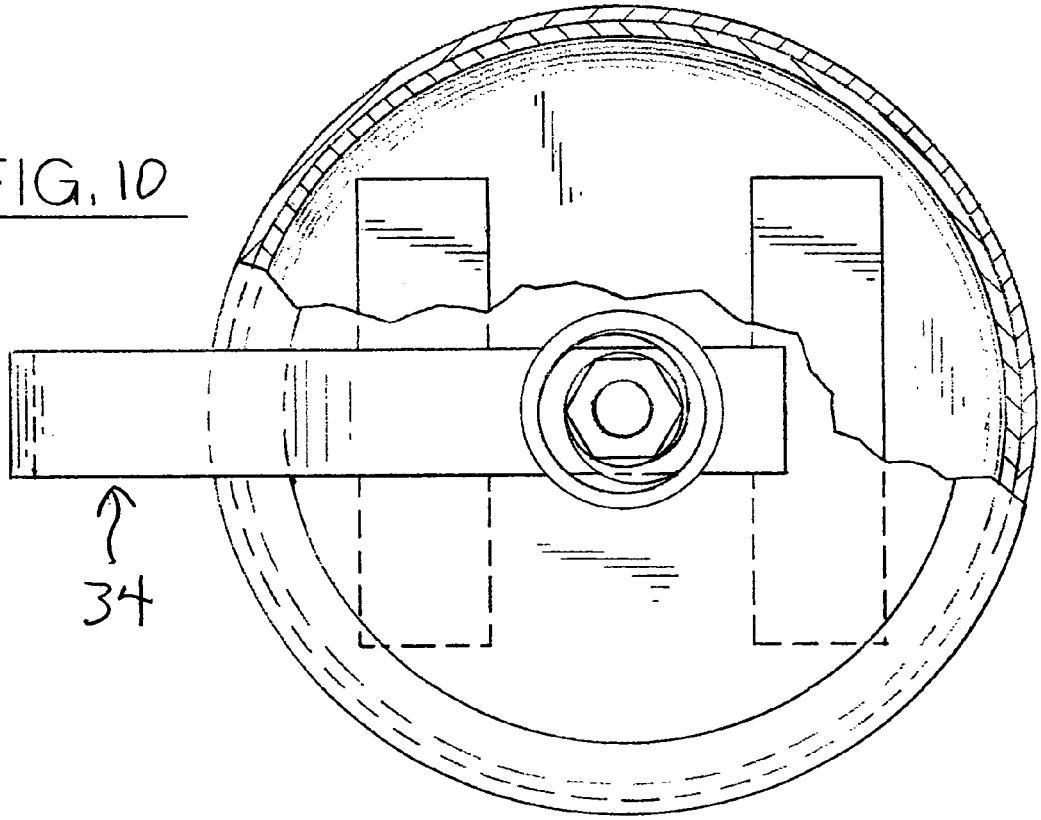
FIG. 10 is a plan view of the embodiment depicted in FIG. 7.

Referring to FIGS. 7 and 10, another alternative form of sign assembly will now be described. Sign assembly L is similar to sign assembly A depicted in FIGS. 1, 2, 5 and 6 and, therefore, only the differences will be described in detail. Sign assembly L includes a handle member 34. Preferably, the handle member 34 is secured between the anchoring member M and the flexible member N. The handle member 34 is held in place by nut and bolt type fasteners. However, any fastener may be used. The handle member 34 preferably includes an arcuate portion 36 that an individual can readily grasp to remove the sign assembly from the supporting surface.

Figure 8:
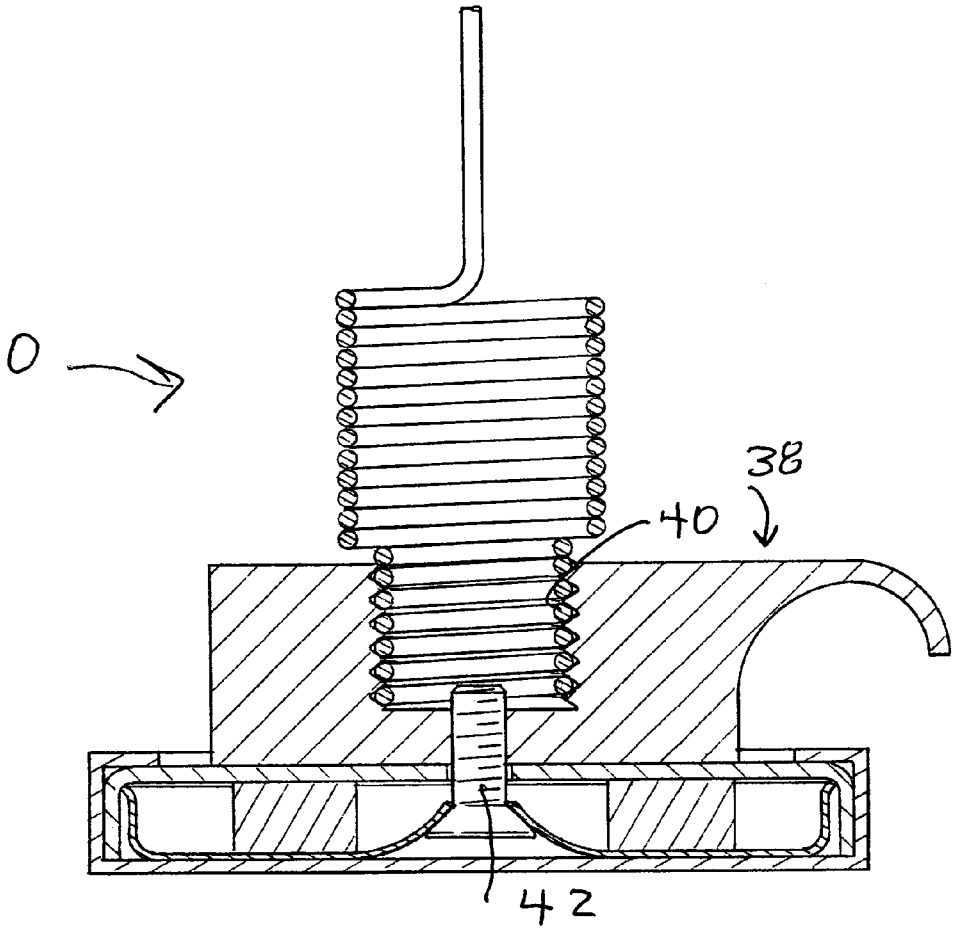
FIG. 8 is a cross-sectional view of still a further embodiment of the present invention with the sign omitted.

Referring to FIG. 8, an alternative form of handle member and flexible member are depicted. Specifically, handle member 38 has a threaded opening to receive the lowermost coils 40 of the flexible member O at one end and bolt 42 at the other end.

Figure 9:
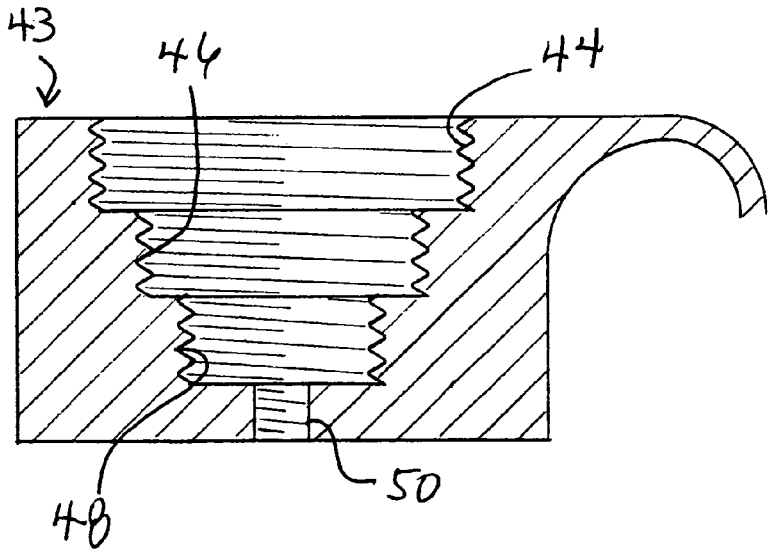
FIG. 9 is a cross-sectional view of one of many alternative forms for the handle.

A handle member 43 is depicted in FIG. 9 in which the threaded opening includes four sections 44, 46, 48 and 50. Sections 44, 46 and 48 receive correspondingly shaped sections of coils of the flexible member (not shown). Section 50 receives the threaded portion of a bolt (not shown).

Figure 16:
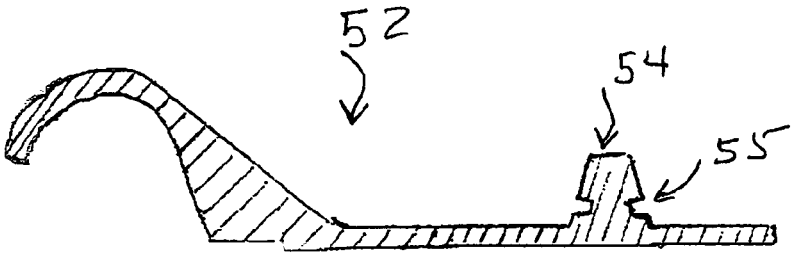
FIG. 16 is a cross-sectional view of one of many alternative forms for the handle.

FIG. 16 depicts handle member 52 having an attachment member 54 extending upwardly to receive the lowermost coil of a corresponding flexible member. The lowermost coil can be press fit onto the attachment member 54 such that a portion of the coil section is received in annular groove 55. The handle member 52 may be secured to the anchoring member in any suitable manner.

Figure 17:
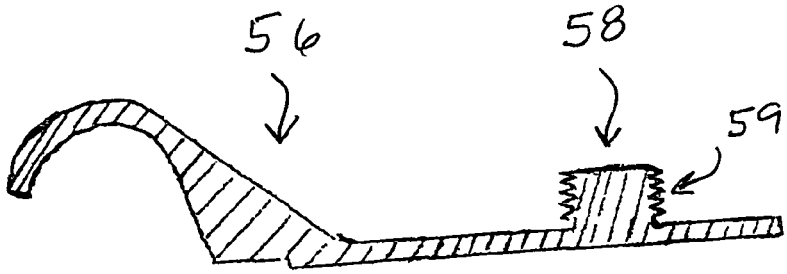
FIG. 17 is a cross-sectional view of one of many alternative forms for the handle.

FIG. 17 depicts handle member 56 having an attachment member 58 extending upwardly to receive the adjacent coils of a corresponding flexible member. The attachment member includes external threads 59. The lowermost coil of a corresponding flexible member may be readily threaded onto attachment member 58. The handle member 54 may be secured to the anchoring member in any suitable manner.

FIGS. 11 to 14

Referring to FIGS. 11 and 12, a further alternative sign assembly is depicted. Specifically, sign assembly P uses clips 60 and 62 to attach the display member Q to flexible members R and S, respectively. Clips 60 and 62 are attached at the bottom of display member Q.

The sign assembly T depicted in FIG. 13 also employs clips to secure the display member to the flexible members. However, clips 64 and 66 are secured to the sides of the display member. The uppermost portions 68 and 70 of the flexible members are bent so that the anchoring members can remain in a similar position to those depicted in FIG. 11.

Figure 14:
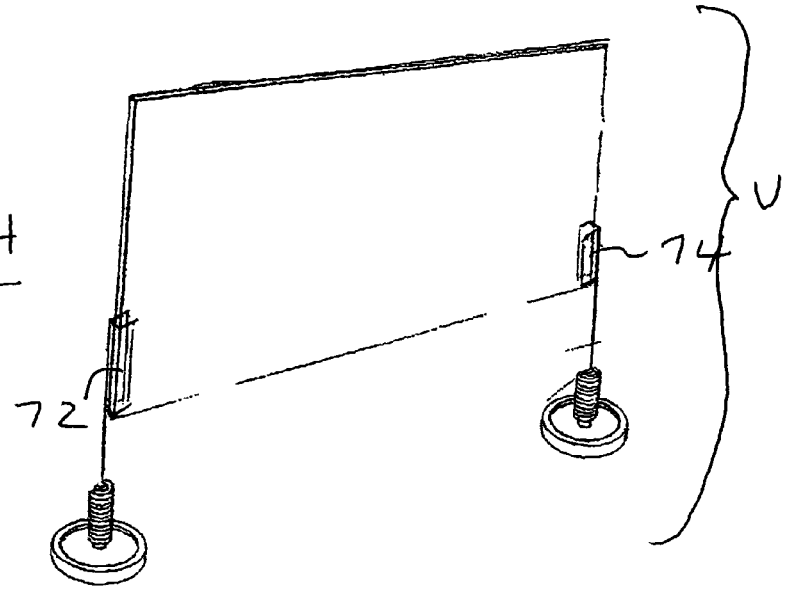
FIG. 14 is a perspective view of a further embodiment of the present invention.

The sign assembly U depicted in FIG. 14 also employs clips to secure the display member to the flexible members. However, clips 72 and 74 are secured to the sides of the display member. The anchoring members are moved to the left and right sides of the display member so that the uppermost portions of the flexible members need not be bent.

While this invention has been described as having a preferred design, it is understood that the preferred design can be further modified or adapted following in general the principles of the invention and including but not limited to such departures from the present invention as come within the known or customary practice in the art to which the invention pertains. The claims are not limited to the preferred embodiment and have been written to preclude such a narrow construction using the principles of claim differentiation.

I claim:

1. A sign assembly for attachment to a portion of a vehicle, said sign assembly comprising:

a) a display member having a top, a bottom, a front face, a rear face, a left side and a right side, said display member further having indicia formed thereon;

(b) at least one anchoring member operably associated with said display member for anchoring said display member to a portion of a vehicle, at least a portion of said anchoring member being magnetic, said anchoring member extending along only a minor portion of said bottom of said display member; and, (c) a flexible member having a longitudinal axis and first and second ends, said flexible member being disposed relative to said anchoring member such that said longitudinal axis passes through said anchoring member, said first end of said flexible member being operably associated with said anchoring member, said second end of said flexible member being operably associated with said display member such that said second end of said flexible member moves with said display member, said flexible member permitting said display member to move relative to said anchoring member.

2. A sign assembly as set forth in claim 1, wherein:

(a) said flexible member includes a coil section and a substantially straight section.

3. A sign assembly as set forth in claim 2, wherein:

(a) said coil section and said substantially straight section are formed as a single piece.

4. A sign assembly as set forth in claim 1, wherein:

(a) said flexible member is a spring.

5. A sign assembly as set forth in claim 1, wherein:

(a) said magnetic portion of said anchoring member extends along only a minor portion of said bottom of said display member.

6. A sign assembly as set forth in claim 1, wherein:
(a) said front surface and said rear surface of said display member are substantially flat.

7. A sign assembly as set forth in claim 1, wherein:
(a) said anchoring member includes a metallic housing for housing and amplifying the strength of said magnetic portion.

8. A sign assembly as set forth in claim 7, wherein:
(a) an elastomeric member surrounds at least a portion of said metallic housing.

9. A sign assembly as set forth in claim 1, wherein:
(a) said flexible member is detachably connected to said anchoring member.

10. A sign assembly as set forth in claim 1, further including:
(a) a handle member, said flexible member being threadedly connected to said handle member.

11. A sign assembly as set forth in claim 10, wherein:
(a) said anchoring member is positioned between said left side and right side of said display member.

12. A sign assembly for attachment to a surface, said sign assembly comprising:
(a) a display member having a top, a bottom, a front face, a rear face, a left side and a right side, said display member further having indicia formed thereon;
(b) at least one anchoring member operably associated with said display member for removably anchoring said display member to a surface, said anchoring member being disposed relative to said display member such that said anchoring member is positioned between said left side and said right side of said display member, said anchoring member extending along only a minor segment of said bottom of said display member; and, (c) a flexible member having first and second ends, said first end of said flexible member being operably associated with said anchoring member, said second end of said flexible member being operably associated with said display member, said flexible member permitting said display member to move relative to said anchoring member.

13. A sign assembly as set forth in claim 12, wherein:
(a) said flexible member is a spring.

14. A sign assembly as set forth in claim 13, wherein:
(a) said spring has a coil section and a substantially straight section, said coil section and said substantially straight section are formed from a single piece.

15. A sign assembly as set forth in claim 14, wherein:
(a) said anchoring member further includes a metallic housing and a magnet at least partially disposed in said metallic housing.

16. A sign assembly as set forth in claim 15, further including: (a) a handle member for facilitating the removal of said anchoring member from the surface, said flexible member being detachably connected to said handle member.

17. A sign assembly for attachment to a portion of a vehicle, said sign assembly comprising:
(a) a display member having a top, a bottom, a front face, a rear face, a left side and a right side, said display member further having indicia formed thereon;
(b) first and second anchoring members operably associated with said display member for anchoring said display member to a portion of a vehicle, said first anchoring member being spaced from said second anchoring member; and, (c) a first flexible member having first and second ends, said first end of said first flexible member being connected to said first anchoring member, said second end of said first flexible member being connected to said display member, said first flexible member permitting said display member to move relative to said first anchoring member, said first flexible member being a single piece of flexible material.

18. A sign assembly as set forth in claim 17, further including:
(a) a second flexible member having first and second ends, said first end of said second flexible member being connected to said second anchoring member, said second end of said second flexible member being connected to said display member.

19. A sign assembly as set forth in claim 18, wherein:
(a) said first and second flexible members are springs having a coil section and a substantially straight section formed from a single piece.

20. A sign assembly for attachment to a portion of a vehicle, said sign assembly comprising:
(a) a display member having a top, a bottom, a front face, a rear face, a left side and a right side, said display member further having indicia formed thereon;
(b) at least one anchoring member operably associated with said display member for anchoring said display member to a portion of a vehicle, at least a portion of said anchoring member being magnetic;
(c) a flexible member having first and second ends, said first end of said flexible member being operably associated with said anchoring member, said second end of said flexible member being operably associated with said display member, said flexible member permitting said display member to move relative to said anchoring member; and,
(d) a handle member for facilitating the removal of said anchoring member from a portion of the vehicle, at least a portion of said handle member being disposed between said anchoring member and said flexible member, said handle member extending along only a minor segment of said bottom of said display member.

21. A sign assembly as set forth in claim 20, wherein:
(a) said handle member is detachably connected to said anchoring member and said flexible member.

22. A sign assembly as set forth in claim 21, wherein:
(a) said handle member includes a substantially arcuate member.

23. A sign assembly for attachment to a portion of a vehicle, said sign assembly comprising: (a) a display member having a top, a bottom, a front face, a rear face, a left side and a right side, said display member further having indicia formed thereon;
(b) at least one anchoring member operably associated with said display member for anchoring said display member to a portion of a vehicle, at least a portion of said anchoring member being magnetic, and, (c) a flexible member having first and second ends, said first end of said flexible member being operably associated with said anchoring member, said second end of said flexible member being operably associated with said display member such that said second end of said flexible member moves with said display member, said flexible member permitting said display member to move relative to said anchoring member, said flexible member including a spring having a plurality of coils, at least one coil of said plurality of coils having an outermost surface disposed inwardly of an outermost surface of at least one other coil of said plurality of coils facilitating attachment of said flexible member to said anchoring member.

* * * * *